US009404717B2

(12) United States Patent
Pfennig et al.

(10) Patent No.: US 9,404,717 B2
(45) Date of Patent: Aug. 2, 2016

(54) VEHICLE, IN PARTICULAR A MILITARY VEHICLE

(75) Inventors: Michael Pfennig, Kassel (DE); Eric Prummenbaum, Kassel (DE); Oliver Meding, Kassel (DE)

(73) Assignee: KRAUSS-MAFFEI WEGMANN GMBH & CO. KG, Munich (DE)

( * ) Notice: Subject to any disclaimer, the term of this patent is extended or adjusted under 35 U.S.C. 154(b) by 0 days.

(21) Appl. No.: 14/002,117

(22) PCT Filed: Feb. 16, 2012

(86) PCT No.: PCT/DE2012/100036

§ 371 (c)(1),
(2), (4) Date: Aug. 28, 2013

(87) PCT Pub. No.: WO2012/116694

PCT Pub. Date: Sep. 7, 2012

(65) Prior Publication Data

US 2014/0216238 A1 Aug. 7, 2014

(30) Foreign Application Priority Data

Feb. 28, 2011 (DE) ..... 10 2011 000 974

(51) Int. Cl.
*F41H 7/04* (2006.01)
*F41H 5/02* (2006.01)

(52) U.S. Cl.
CPC ..... *F41H 7/044* (2013.01); *F41H 5/02* (2013.01); *F41H 7/042* (2013.01); *F41H 7/048* (2013.01)

(58) Field of Classification Search
USPC ..... 89/36.08, 36.09
See application file for complete search history.

(56) References Cited

U.S. PATENT DOCUMENTS

| | | | | |
|---|---|---|---|---|
| 4,031,807 | A * | 6/1977 | Boyer | 89/36.13 |
| 4,326,445 | A | 4/1982 | Bemiss | |
| 4,676,545 | A * | 6/1987 | Bonfilio et al. | 296/193.04 |
| 4,818,562 | A | 4/1989 | Arcella et al. | |
| 5,663,520 | A * | 9/1997 | Ladika | F41H 5/226 296/187.07 |
| 5,747,721 | A | 5/1998 | Speakes et al. | |
| 7,228,927 | B2 | 6/2007 | Hass et al. | |
| 7,441,809 | B1 | 10/2008 | Coombs et al. | |
| 7,695,053 | B1 * | 4/2010 | Boczek | F41H 7/044 296/148 |
| 8,146,477 | B2 * | 4/2012 | Joynt | F41H 7/042 296/187.07 |

(Continued)

FOREIGN PATENT DOCUMENTS

| | | |
|---|---|---|
| CA | 2630221 | 5/2007 |
| DE | 3206794 | 9/1983 |

(Continued)

OTHER PUBLICATIONS

PCT, International Search Report; International Patent Application No. PCT/DE2012/100036 (Jul. 23, 2012).

(Continued)

*Primary Examiner* — Michael David
(74) *Attorney, Agent, or Firm* — Thompson Hine LLP

(57) ABSTRACT

The invention relates to a vehicle, especially a military vehicle, comprising a front section (2) and a rear section (3) and a safety cell (4) arranged between the front section (2) and the rear section (3) and receiving the vehicle crew, the front section (2) and the rear section (3) being connected to each other in the region below the safety cell (4) by means of a protective element (5) which protects the safety cell (4) from the impact of blasts.

11 Claims, 2 Drawing Sheets

(56) References Cited

U.S. PATENT DOCUMENTS

| | | | | |
|---|---|---|---|---|
| 8,146,478 | B2 * | 4/2012 | Joynt | F41H 7/042 296/187.07 |
| 8,205,703 | B2 * | 6/2012 | Halliday | F41A 23/34 180/89.1 |
| 8,714,632 | B2 * | 5/2014 | Chapman | 296/193.04 |
| 8,740,286 | B2 * | 6/2014 | Aizik et al. | 296/187.08 |
| 8,904,916 | B2 * | 12/2014 | Hunn | F41H 7/042 296/187.08 |
| 8,960,068 | B2 * | 2/2015 | Jacquemont | F41H 7/042 296/187.07 |
| 2006/0266119 | A1 | 11/2006 | Cobb | |
| 2007/0000328 | A1 | 1/2007 | Buttram | |
| 2007/0006656 | A1 | 1/2007 | Batzinger et al. | |
| 2009/0140545 | A1 * | 6/2009 | Greuter | F41H 7/042 296/187.07 |
| 2010/0019538 | A1 | 1/2010 | Kiley et al. | |
| 2010/0163330 | A1 | 7/2010 | Halliday | |
| 2011/0272968 | A1 * | 11/2011 | Medwell | F41H 7/04 296/193.03 |
| 2012/0312607 | A1 * | 12/2012 | Joynt | F41H 7/042 180/54.1 |

FOREIGN PATENT DOCUMENTS

| | | |
|---|---|---|
| DE | 102006051870 | 5/2007 |
| DE | 102008019656 | 10/2009 |
| EP | 1564518 | 8/2005 |
| EP | 1815936 | 8/2007 |
| FR | 2510737 | 2/1983 |
| FR | 2916528 | 11/2008 |
| WO | 2009/112799 | 9/2009 |

OTHER PUBLICATIONS

PCT, Written Opinion; International Patent Application No. PCT/DE2012/100036 (Aug. 31, 2013).

PCT, International Preliminary Report on Patentability; International Patent Application No. PCT/DE2012/100036 (Sep. 3, 2013).

PCT, International Search Report; International Patent Application No. PCT/DE2012/000036 (Aug. 23, 2012).

PCT, Written Opinion; International Patent Application No. PCT/DE2012/000036 (Jul. 18, 2013).

PCT, International Preliminary Report on Patentability; International Patent Application No. PCT/DE2012/000036 (Jul. 19, 2013).

Amado-Becker, Antonio et al.; "Elastic tensor stiffness coefficients for SLS Nylon 12 under different degrees of densification as measured by ultrasonic technique"; Rapid Prototyping Journal; vol. 14, No. 5; pp. 260-270 (Jan. 1, 2008).

* cited by examiner

VEHICLE, IN PARTICULAR A MILITARY VEHICLE

The instant application should be granted the priority dates of Feb. 28, 2011, the filing date of the corresponding German patent application 10 2011 000 974.4, as well as Feb. 16, 2012, the filing date of the International patent application PCT/DE2012/100036.

BACKGROUND OF THE INVENTION

The invention relates to a vehicle, in particular a military vehicle, with a front section and a rear section as well as a safety cell arranged between the front section and the rear section for receiving the vehicle crew.

Vehicles with a front section carrying a front axis and a rear section carrying one or more rear axles, which are releasably connected with an often ballistically protected safety cell, are used in particular in military fields for modular construction of different vehicle types. The safety cells for receiving vehicle occupants is embodied to be highly protected by means of ballistic protective plates, so that adversarial projectiles cannot penetrate in the interior of the protective safety cell. By the releasable connection of the safety cell with the front or rear sections, the vehicle can be equipped according to the expected threat with different levels of protection, for example with different safety cells.

This type of three-part structure of a military vehicle with a front section, a rear section as well as a safety cell is described in EP 1 564 518 A1.

While the safety cell can be protected by application of corresponding protective plates without anything further from ballistic threats, mine threats primarily cause problems. A main problem is that the protective elements arranged beneath the safety cell deform in the direction of the inner chamber of the safety cell as a result of a two-dimensional explosive action of a mine detonation, which is connected with a heightened risk for life and limb of the crew members.

In order to reduce this risk, in terms of construction, at least in part, very expensive countermeasures are used in the interior of the safety cell. Thus, for example, it is known to arrange elements disposed in the interior of the safety cell in a suspended arrangement on the roof of the safety cell, so that a deformation of the floor of the safety cell is not transferred directly on the interior of the safety cell and therewith, to the bodies of the crew members.

SUMMARY OF THE INVENTION

The object of the present invention is to provide a vehicle, in which crew members within the safety cell are protected in a simple manner from the impact of an explosion.

This object is solved with a vehicle of the above-described type, in which the front section and the rear section are connected in a region beneath the safety cell via a protective element that shields the safety security cell from the effects of mines.

The protective element is not connected with the safety cell, but only with the front or rear section. No direct contact exists between the protective element and the safety cell. In the event an explosion acts on the protective element, the explosion does not directly impact in the safety cell, but the resulting initiation of the shock resulting from the explosion is first conducted from the protective element into the front or rear section. Via the front or rear section, this force then contacts the safety cell with a known lateral delay and is substantially weakened. A longer route of the initiation of the shock effects that occur with an explosion is provided that extends over the front or rear section. The weakening connected therewith permits in a simple, constructive manner an effective protection of the personnel within the safety cell.

The advantageous design contemplates that the protective element and the safety cell are arranged to be decoupled from one another, such that an explosion acting on the protective element takes a path via the front or rear section onto the safety cell. Via the front or rear section, the explosion or the shock effects resulting indirectly therefrom are transferred over the longer path via the front or rear section onto the safety cell, so that the explosion or shock effects on the safety cell are weakened. Based on this weakening, it is not necessary to have expensive features for protecting the crew in the interior.

A further embodiment contemplates that the safety cell is rigidly connected via mounting points with the front section and rear section, whereby a vehicle structure with greater strength with a comparably minimal weight can be achieved. In particular, the mounting points can be formed as a type of bearing, which supports the safety cell on corresponding counter surfaces of the front section or the rear section.

In a constructive further embodiment of the invention, it is further proposed that the mounting points are arranged on the front and rear sides of the safety cell. In particular, the mounting points can be arranged approximately at half the heights of the front or rear sides of the safety cell. On the lower side of the safety cell, no connecting points between the safety cell and the protective element are provided.

A beneficial embodiment of the invention having a minimal vehicle weight contemplates that the safety cell is formed as self-supporting and forms a self-supporting central part of the vehicle. It is not necessary to provide further support elements such as vehicle frames extending from the front to the rear sections, whereby a relatively lightweight structure of the vehicle can be realized. In addition, it is possible to exchange the safety cell and the protective element because of variations of other lengths, which is a further benefit of the basic concept of the vehicle.

It is further proposed that also the protective element forms a part of the support structure, which is beneficial in the total rigid vehicle construction. Also, the protective element can be replaced by another protective element for mission-specific purposes and can be integrated into the vehicle structure.

A further embodiment contemplates that the protective element is connected via connections with the front section and the rear section. Via the connections, the protective element can be connected releasably with the front or rear section and can be exchanged according to the specific mission. The connection can be rigid, whereby the connections preferably are arranged fixedly on the front or rear section.

An advantageous construction in view of the weakening of the explosion effects contemplates that the mounting points are arranged above the connections. Via the connections, the explosion acting on the protective element and the resulting shock effects are led first into the region of the front or rear section and then must be overcome within the front or rear section according to known vertical path before they can enter into the safety cell via the higher mounting points. Preferably, the distance between the mounting points and the connections is at least a third of the height of the safety cell, still more preferably at least half the height of the safety cell.

A further advantageous embodiment contemplates that the connections are formed as collapsible zones that are vertically deformable under the effects of an explosion. By deformation of the connections in the manner of collapsible zones, a part of the energy released by the explosion is converted into deformation energy so that the energy effect on the safety cell is weakened.

A constructive embodiment contemplates that the connections have a vertically extending angle and a flange extending horizontally for attachment of the protective element. The angle extending in the vertical direction can deform under the effects of an explosion in the manner of a collapsible zone, whereby the flange serves for attachment of the protective element.

According to a further advantageous embodiment, the protective element extends beneath the safety cell when a deformation space is formed. Deformations of the protective element occurring as a result of an explosion are formed in the deformation space, without penetrating through the bottom of the higher safety cell.

In a further embodiment, it is proposed that the protective element is formed as a type of mine protective plate that shields the underside of the safety cell from the effects of an explosion. The mine protective plate can extend continuously from one of the vehicle sides to the opposite side.

In order to optically cover the deformation space from an attacker, it is proposed that the protective element is provided with lateral raised portions for covering the deformation space. The raised portions can engage the safety cell in the manner of a lateral overlap and provide a visual covering of the deformation space. In addition, the rigidity of the protective element can be improved by the raised portions.

Finally, it is proposed that the protective element is formed by an aluminum plate. The protective element can be made from one piece, without the welding points disturbing the strength of the aluminum plate. Preferably, the thickness of the protective element made from an aluminum plate should be in the range of greater than 50 mm, preferably 75 mm and more preferably, greater than 100 mm.

BRIEF DESCRIPTION OF THE DRAWINGS

Further advantages and details of a vehicle according to the present invention will be explained next with reference to the accompanying figures of an exemplary embodiment. In the figures.

DETAILED DESCRIPTION OF THE PREFERRED EMBODIMENTS

Figure 1:
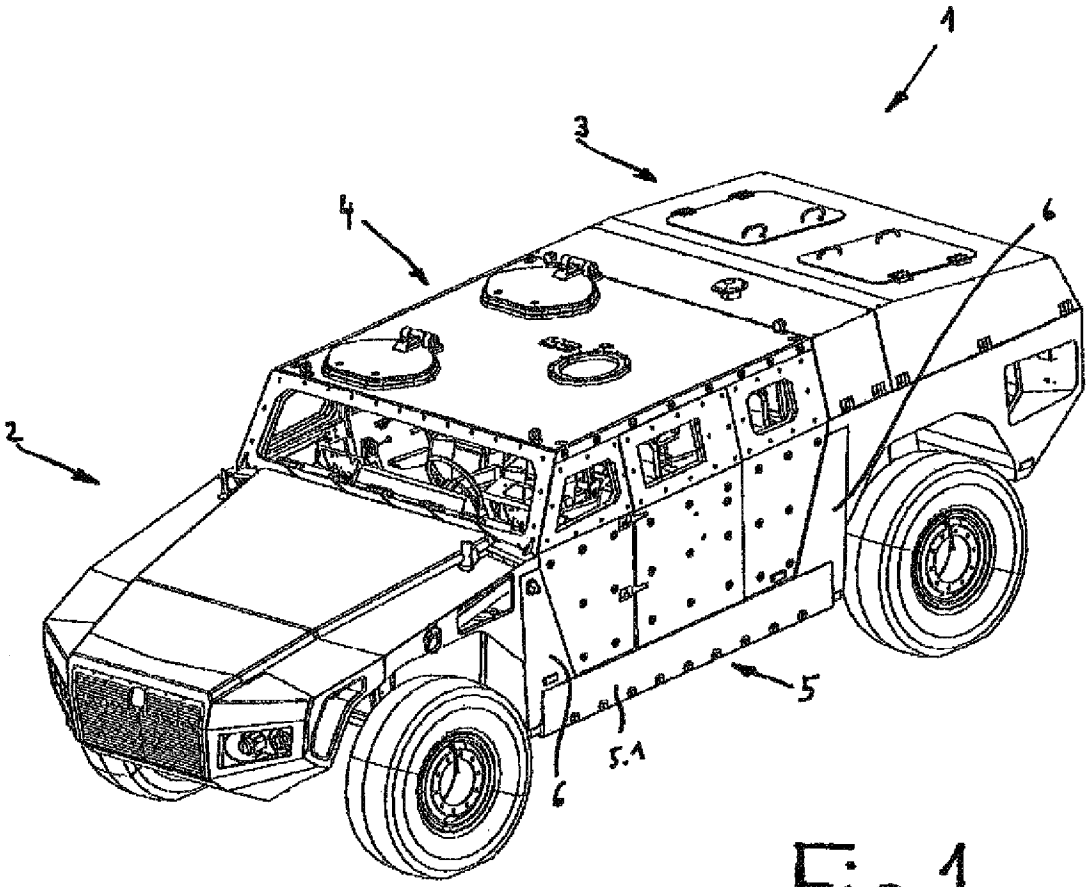
FIG. 1: shows a perspective view of a vehicle.

FIG. 1 shows a vehicle 1, which is a military vehicle that is protected against ballistic attacks as well as the effects of mine, for example explosions.

The vehicle 1 has a modular structure comprising a front section 2 and a rear section 3, which are connected releasably with a safety cell 4 embodied to be protected from ballistics. In this manner, it is possible to substitute the safety cell 4 in a mission-specific manner in a simple manner with another safety cell 4 with other personnel reinforcements, other levels of protection, other add-on kits, and so forth.

The vehicle 1 can be driven by means of an engine arranged in the front section 2 or the rear section 3. Alternatively, it is contemplated that the front section 2 as well as the rear section 2, respectively, are each equipped with an individual engine, which provides improved emergency properties to the vehicle 1 in the event of severe damage to one of the two sections 2, 3.

A protective element 5 that extends from one of the vehicle sides to the opposite vehicle side is provided beneath the safety cell 4 and protects the safety cell 4 from an explosion coming from beneath the safety cell 4, for example from a mine detonation.

Figure 2:
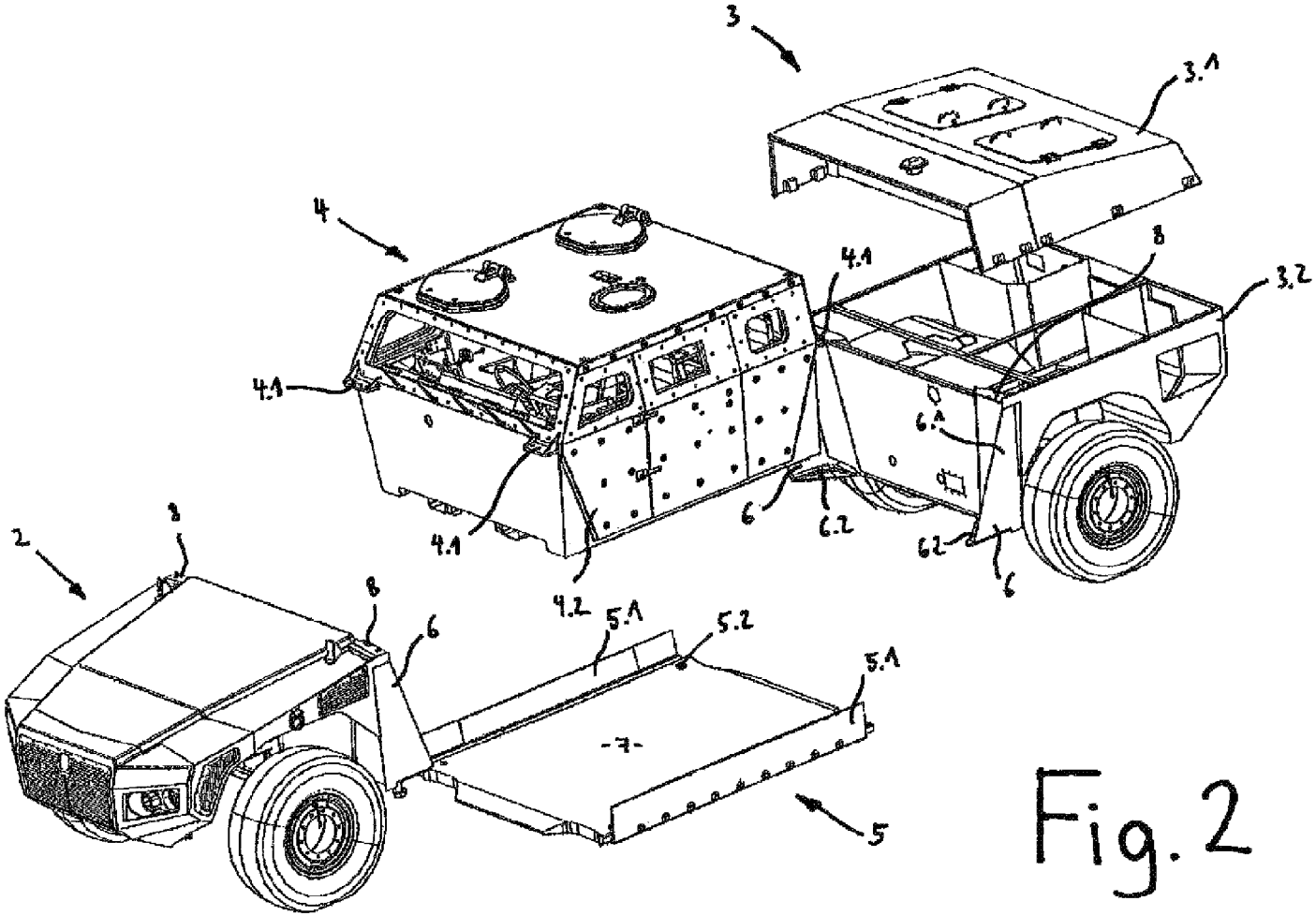
FIG. 2: shows an exploded view of the different vehicle parts of the vehicle according to FIG. 1.

Details of the operation and structure of the protective element 5 will be explained subsequently with reference to FIG. 2.

The protective element 5 extends in the region beneath the safety cell 4 from the front section 2 to the rear section 3, which has no direct connect with the safety cell 4. Based on this uncoupled arrangement of the protective element 5 and the safety cell 4, an explosion acting on the protective element 5 is not conducted directly from the protective element 5 into the safety cell 4. The resulting shock effect resulting from the explosion takes place indirectly via the front section 2 or the rear section 3, while the corresponding shock pressure is weakened as it moves to the safety cell 4, which will be described in greater detail below.

For connection of the protective element 5 with the front section 2 and the rear section 3, connections 6 are provided on the front section 2 and the rear section 3, on which the protective element 4 is releasably mounted. With the exemplary embodiment, the protective element 5 has openings 5.2 in its corner regions, so that the protective element 5 can be rigidly attached to the connections 6 provided on front section 2 or rear section 3 by means of screw. Through the rigid connection of the protective element 5 on the front section 2 as well as the rear section 3, the massively formed protective element 5 forms a part of the support structure of the vehicle 1.

The protective element 5 has a generally U-shaped geometry, whereby the legs of the U are formed by lateral raised portions 5.1. The raised portions 5.1 are arranged in the area of the edges of the protective element 5 and terminate tightly beneath and somewhat laterally to the access doors 4.2 of the safety cell 4 upon formation of a deformation space 7 (compare the representation in FIG. 1).

The protective element 5 is formed by a massive aluminum plate, which is manufactured from one piece with the exception of the lateral raised portions 5.1, so that no welding seams or other weak points that would affect detrimentally the protective action are provided. The lateral raised portions 5.1 are connected via screws with the otherwise one-piece protective element 5.

The connections 6 for mounting the protective element 5 comprise an angle 6.1 forming a collapsible zone as well as flange plate 6.2 disposed on an underside of the angle 6.1, on which the protective element 5 is attached via screws. Two connections 6 are provided on the front section 2 and two connections 6 on the rear section 3. The connections 6 are arranged on the exterior of the vehicle on both sides of the front and rear sections 2, 3, whereby the angle 6.2 opens toward the vehicle interior. The legs of the angle 6.2 engage in the mounted state around the adjacent corners of the safety cell 4. The corners of the safety cell 4 lie loosely within the angle 6.2

The safety cell 4 also is rigidly connected with the front section 2 as well as the rear section 3 via corresponding mounting points 4.1. A connection with the protective element 5, however, does not exist. The mounting points 4.1 are arranged on the front side and the rear side of the safety cell 4 in their corners and are formed as a clip-like bearing, which substantially rests on counter surfaces 8 of the front section 2 or rear section 3 running substantially horizontally and are releasably attached via screws. The mounting elements 4.1 are located in the exemplary embodiment approximately at the height of a horizontal central plane of the safety cell 4 above the connections 6.

The safety cell 4 is formed to be self-supporting and like the protective element 5, forms a part of the support structure of the vehicle 1, whereby a high rigidity or strength of the vehicle is provided. It is not necessary to provide an additional support frame or another similar element in the central region of the vehicle 1, which makes possible, on the one hand, a relatively minimal vehicle weight and on the other hand, is beneficial to the modular basic structure of the vehicle 1.

Next, the manner of operation of the protective element 5 and the individual processes which occur when a mine is run over, will be described in detail.

Upon driving over a mine, gas vapors having a high kinetic energy exist upon detonation of the corresponding explosive material, which acts as an explosion two-dimensionally on the protective element 5 coming from the vehicle sides. Based on the significant, percussive-type forces that occur, the protective element 5 begins to form deformation space 7 between the protective element 5 and the safety cell 4 without impacting on the bottom of the safety cell 4. At the same time, the shock pressure is conducted as shock via the receivers 6 in the front and rear sections 2, 3. Via the flanges 6.2, the forces are conducted into the region of the angles 6.1 formed as collapsible zones. With sufficiently strong forces, the angles 6.1 begin to deform in a as a result of the introduction of shock as collapsible zones, whereby these absorb in a known amount the detonation energy in the form of deformation energy.

At the upper ends of the connections 6, the shock pressure final is conducted via the mounting points 4.1 into the safety cell 4.

Since the safety cell 4 and the protective element 5 are not directly connected to one another, the shock pressures resulting from the explosive effect are only indirectly conducted into the safety cell 4 via the front section 2 or the rear section 3. A known lateral deceleration is provided, which has the result that with a mine detonation, pressure spikes that typically occur during the first milliseconds, are not conducted into the safety cell 4. A further weakening of the shock pressure occurs therefore by absorption of deformation energy in the region of the connections 6, so that shock pressures produced as a result of the explosive effect are greatly weakened as they act on the safety cell 4 and this can be embodied constructively simply with regard to personnel protection. Thus, it is not necessary to form interior components of the safety cell 4 in a suspended arrangement.

The specification incorporates by reference the disclosure of DE 10 2011 000 974.4, filed Feb. 28, 2011, as well as International application PCT/DE2012/100036, filed Feb. 16, 2012.

The present invention is, of course, in no way restricted to the specific disclosure of the specification and drawings, but also encompasses any modifications within the scope of the appended claims.

REFERENCE NUMERAL LIST

1 Vehicle
2 Front section
3 Rear section
4 Safety cell
4.1 Mounting position
4.2 Door
5 Protective element
5.1 raised portion
5.2 opening
6 connection
6.1 angle
6.2 flange
7 deformation space
8 counter surface

The invention claimed is:

1. A military vehicle, comprising:
a front section;
a rear section;
a safety cell disposed between the front section and the rear section for receiving a vehicle crew, the safety cell is attached directly to the front section and to the rear section by front and rear mounting points;
a protective element positioned beneath the safety cell and extending from a side of the vehicle to an opposite side of the vehicle such that no direct contact exists between the protective element and the safety cell; and
a plurality of connections that attach the protective element directly to both sides of the front section and to both sides of the rear section, each of the plurality of connections having an angle attached to one or the other of the front section and the rear section, a flange plate on the underside of the angle, the protective element attached directly to the flange plate, and the angle opening toward the vehicle interior such that the angle engages an exterior corner of the safety cell, and the connections are not attached directly to the safety cell;
wherein the protective element and the plurality of connections are uncoupled from the safety cell such that an explosion acting on the protective element takes a path via the front section or rear section onto the safety cell.

2. The military vehicle according to claim 1, wherein the mounting points are arranged on front and rear sides of the safety cell.

3. The military vehicle according to claim 1, wherein the safety cell is self-supporting and forms a self-supporting central part of the vehicle, such that no additional support frame or support element is required in a central region of the vehicle.

4. The military vehicle according to claim 1, wherein the protective element forms a part of a support structure of the vehicle.

5. The military vehicle according to claim 1, wherein the mounting points are arranged above the connections.

6. The military vehicle according to claim 1, wherein the connections are as a collapsible zone that is vertically deformable upon an impact of explosion.

7. The military vehicle according to claim 1, wherein the protective element forms a deformation space beneath the safety cell.

8. The military vehicle according to claim 1, wherein the protective element is a mine protection plate disposed to shield an underside of the safety cell from an impact of explosion.

9. The military vehicle according to claim 7, wherein the protective element is provided with lateral raised portions for covering the deformation space.

10. The military vehicle according to claim 1, wherein the protective element is formed as an aluminum plate.

11. A military vehicle, comprising:
a front section;
a rear section;
a safety cell disposed between the front section and the rear section for receiving a vehicle crew, the safety cell is attached directly to the front section and to the rear section by front and rear mounting points;

a protective element positioned beneath the safety cell and extending from a side of the vehicle to an opposite side of the vehicle such that no direct contact exists between the protective element and the safety cell; and a plurality of connections that attach the protective element directly to both sides of the front section and to both sides of the rear section, each of the plurality of connections having an angle attached to one or the other of the front section and the rear section, a flange plate on the underside of the angle, the protective element attached directly to the flange plate, and the angle opening toward the vehicle interior such that the angle engages an exterior corner of the safety cell, and the connections are not attached directly to the safety cell;

wherein the protective element and the plurality of connections are uncoupled from the safety cell such that an explosion acting on the protective element takes a path via the front section and the rear section onto the safety cell.

* * * * *